US010238163B2

(12) United States Patent
Jacobsen

(10) Patent No.: US 10,238,163 B2
(45) Date of Patent: Mar. 26, 2019

(54) HELMET STRAP ATTACHMENT METHOD AND DEVICE

(71) Applicant: Bell Sports, Inc., Scotts Valley, CA (US)

(72) Inventor: Gregg T. Jacobsen, Santa Cruz, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 489 days.

(21) Appl. No.: 14/940,348

(22) Filed: Nov. 13, 2015

(65) Prior Publication Data

US 2016/0135535 A1 May 19, 2016

Related U.S. Application Data

(60) Provisional application No. 62/079,465, filed on Nov. 13, 2014.

(51) Int. Cl.
*A42B 3/08* (2006.01)
*A42B 3/14* (2006.01)

(52) U.S. Cl.
CPC ..... *A42B 3/08* (2013.01); *A42B 3/14* (2013.01); *A42B 3/145* (2013.01); *A42B 3/147* (2013.01)

(58) Field of Classification Search
CPC .... A42B 3/08; A42B 3/14; A42B 3/32; A42B 3/324
USPC ..... 2/417, 421
See application file for complete search history.

(56) References Cited

U.S. PATENT DOCUMENTS

| | | | | |
|---|---|---|---|---|
| 4,932,076 | A | 6/1990 | Grigio et al. | |
| 5,598,588 | A | 2/1997 | Lee | |
| 5,898,949 | A * | 5/1999 | Barthold | A42B 3/14 2/411 |
| 6,711,751 | B1 | 3/2004 | Muskovitz | |
| 2010/0281603 | A1 | 11/2010 | Ho | |
| 2013/0117913 | A1 | 5/2013 | Rogers et al. | |
| 2015/0237972 | A1* | 8/2015 | Kolasa | A44B 11/26 24/197 |

FOREIGN PATENT DOCUMENTS

| | | |
|---|---|---|
| DE | 202004013874 | 12/2004 |
| EP | 1714569 | 10/2006 |
| WO | 9113560 | 9/1991 |
| WO | WO1991013560 | 9/1991 |

* cited by examiner

*Primary Examiner* — Katherine Moran
(74) *Attorney, Agent, or Firm* — Booth Udall Fuller, PLC

(57) ABSTRACT

An anchoring system for securing a strap to an in-molded helmet can include a strap anchor that includes an anchor housing and an in-molding flange coupled to the anchor housing. The anchoring system can include a bar tack clip sized to fit partially within the anchor housing, the bar tack clip including a cross beam, an opening adjacent the cross beam, and at least one clip coupled to the cross beam and sized to mateably couple with the anchor housing. The anchoring system can also include a strap disposed through the opening in the bar tack clip and looped around the cross beam, the strap being coupled to itself with a bar tack. The at least one clip of the bar tack clip can be disposed at an in-bound side of the bar tack clip or can include two side clips.

12 Claims, 11 Drawing Sheets

HELMET STRAP ATTACHMENT METHOD AND DEVICE

RELATED APPLICATIONS

This application claims the benefit of U.S. provisional patent application 62/079,465, filed Nov. 13, 2014 titled "Helmet Strap Attachment Method and Device," the entirety of the disclosure of which is incorporated by this reference.

TECHNICAL FIELD

This disclosure relates to a helmet strap attachment method and device.

BACKGROUND

Protective headgear and helmets have been used in a wide variety of applications and across a number of industries including sports, athletics, construction, mining, military defense, and others, to prevent damage to a user's head and brain. Damage and injury to a user can be prevented or reduced by helmets that prevent hard objects or sharp objects from directly contacting the user's head. Damage and injury to a user can also be prevented or reduced by helmets that absorb, distribute, or otherwise manage energy of an impact. Straps or webbing are typically used to allow a user to releasably wear their helmet, and to ensure the helmet remains on the user's head during an impact.

When straps or webbing are used to releasably couple a helmet to a user's head, a helmet anchoring system or attachment system generally comprises strapping attachment points that couple the one or more straps the helmet. Like the helmet and straps, the strapping attachment points undergo large loading forces during impacts whether during an accident or for testing of various safety standards. By ensuring the helmet-strap attachment points are robust and can withstand the forces of impacts, the user can be safeguarded from untimely dis-attachment of the webbing system during mishap.

Strap attachment or anchoring systems for helmets have conventionally been of two different types: 1) in-molded straps, and 2) post molded straps. In-molded strap attachment is used for in-molded helmets in which a protective shell is formed of a molded material, such as expanded polystyrene (EPS) foam or other material. The protective shell can be formed by injecting or expanding material, such as beads of plastic or foam, into a helmet mold under specific conditions, such as temperature, to allow for the formation of protective material within the mold. After molding is complete, the helmet or portion of the helmet can be removed from the mold for completion and use. In-molded straps are incorporated into the helmet, and attached thereto, during the molding process. Attachment straps or webbing can be disposed within the helmet mold at the time of molding so that straps are incorporated as part of the helmet. Temperature and other conditions of the molding process are controlled to ensure the straps or webbing will not be damaged by the helmet molding process. Post molded straps, as described below are attached after the formation or molding of the helmet or protective shell.

For conventional post-molding attachment of straps there are two common types of attachment: 1) riveting straps or webbing to an external shell of the helmet, such as external shells formed of (ABS), and 2) attaching webbing to in-molded mount features. The in-molded mount features can be incorporated into the helmet, and attached thereto, during the molding process by disposing the in-molded mount features within the helmet mold at the time of molding so that the in-molded mount features are incorporated as part of the helmet. The straps or webbing can be coupled to the in-molded mount features, as shown and discussed below, with respect to FIG. 1 and FIGS. 2A-2D.

A first approach for coupling straps or webbing to in-molded mount features can be referred to as a snow anchor method or a ski anchor method. An example of a traditional snow anchor is shown below in FIG. 1.

FIG. 1 shows a strap anchor, snow anchor, or ski type strap anchor 10 that has been conventionally used for in-molded helmets, including ski helmets or other snow helmets, for coupling a strap to the in-molded helmet. The strap anchor 10 can comprise two basic portions, i) a strap anchor body 14, which can include the opening 12 and ii) a web, reinforcing attachment, fins, parachutes, anchoring geometry, or reinforcing attachment point 16 that couples the strap anchor 10 to a helmet or helmet body.

The opening 12 of the strap anchor 10 can receive a strap can be inserted into the opening to couple the strap to the strap anchor 10. Afterwards, the strap can then couple the ski helmet to a head of a user. When the strap anchor 10 is coupled to the helmet, the web 16 of the strap anchor 10 can be disposed within an energy-absorbing material or layer of the helmet, such as a layer of expanded polystyrene (EPS) foam or other suitable material. The web 16 can be sufficiently large, and include sufficient anchoring geometry, to secure the strap anchor 10 to the helmet by fixing the web 16 within the energy-absorbing material and remain firmly coupled during impacts. When the ski anchor 10 is coupled to a helmet body, the web 16 can be imbedded within the helmet body.

The strap or webbing of the helmet can be coupled to the strap anchor 10 by forming a loop in an end of the strap and inserting a pin through the loop of the strap. The loop in the webbing can be formed by folding and end of the strap or webbing over on itself and securing the end of the strap to a center portion of the strap with a bar tack, i.e. sewing. Then, the pin can be disposed through the loop in the strap, and the pin can then be secured to the strap anchor body 14 by disposing the pin and a portion of the strap into the opening 12 in the lower portion of the strap anchor body 14 on an inside of the helmet. As used herein the inside or in-bound side of the helmet refers to the side of the helmet that is adjacent or touches the head of the user, is opposite the outside of the helmet or both.

As such, traditional snow anchors such as strap anchor 10 shown in FIG. 1 remain visible to the consumer after the helmet is formed. Additionally, the attachment apparatus of the helmet, i.e. the metal pin securing the closed loop end of the webbing, is also visible. Because the strap anchor 10 is attached or coupled to the strap on the inside surface of the helmet, a plastic outer shell of the in-molded helmet, which is usually present at the time of in-molding, does not need to be integrated, modified, or sized with the strap anchor 10 because the plastic outer shell and the strap anchor 10 are separated by the in-molded material.

As shown in FIGS. 2A-2D, another method or apparatus commonly used is a shell-mounted anchor or housing 20. The shell-mounted anchor 20 can be similar to the traditional strap anchor 10 in some respects, but differs from the traditional strap anchor 10 by being affixed to the plastic shell, wherein the shell-mounted anchor 20 can be in-molded with the plastic shell 22 at a same time to secure the shell-mounted anchor 20 to a hole, opening, or punched hole in the plastic shell 22. In some instances, the shell-mounted anchor 20 is attached to the shell 22 by snapping the shell-mounted anchor 20 into a punched hole in the shell, the hole being sized to fit and hold by friction, the shell-mounted anchor 20. As such, the anchor 20 can be disposed within an energy management material 23 of the in-molded helmet 25.

FIG. 2A shows that only the bottom most portion of the shell-mounted anchor 20, such as a bottom portion of a strap anchor over-mold clip or over-molded snap engagement feature 24 that is visible to the user, and that a strap anchor snap tab, anchor engagements, fins, or webs 26 that are hidden below the plastic shell 22. FIG. 2B, included below, shows a side view of an example of an entire shell-mounted anchor 20 pictured outside the shell 22 and a helmet, such as before the shell-mounted anchor 20 is mounted to the shell 22 and within a helmet.

FIG. 2B is labeled to indicate that the shell mounted anchor clip 20 can be coupled to webbing or strap 28, and can comprise a strap anchor over-mold clip 24, and a cover 30. The strap anchor over-mold clip 24 can be formed over an end of webbing 28 with a plastic injection strap anchor over-mold clip 24 that can be mateably inserted into the strap anchor snap tab 26 after the helmet is molded. Insertion of the over-mold clip 24 into the strap anchor 26 can be a one-way trip. In other words, once the over-mold clip 24 is inserted to the strap anchor 26, the over-mold clip 24 and strap anchor 26 will permanently, and not releasably, coupled so that the over-mold clip 24 will not release unless the over-mold clip 24, the strap anchor 26, or both are destroyed. The shell mounted anchor 20 and system for using the same can be desirable for its cosmetic appearance, among other things.

FIG. 2C, similar to FIG. 2A, shows a close-up perspective view of the over-mold clip 24 coupled to the bottom most portion of the shell-mounted anchor 20, as shown in FIG. 2B, and exposed from the plastic shell 22. FIG. 2C also provides the additional detail of the webbing 28 coupled to the shell-mounted anchor and extending from the over-mold clip 24.

FIG. 2D shows a cross-sectional profile view of shell-mounted anchor 20 taken along section-line 2D-2D shown in FIG. 2B. The cross-sectional view of FIG. 2D shows how the over-molded clip 24 engages with the strap anchor snap tab 26 within the shell-mounted anchor 20.

SUMMARY

A need exists for helmet strap attachment and methods for providing the same. Accordingly, in an aspect, an anchoring system for securing a strap to an in-molded helmet can comprise a strap anchor that comprises an anchor housing, and an in-molding flange coupled to the anchor housing and sized to hold the strap anchor within the in-molded helmet. The anchoring system can comprise a bar tack clip sized to fit partially within the anchor housing, the bar tack clip can further comprise a cross beam, an opening adjacent the cross beam, and at least one clip coupled to the cross beam and sized to mateably couple with the anchor housing. The anchoring system can comprise a strap disposed through the opening in the bar tack clip and looped around the cross beam, the strap being coupled to itself with a bar tack.

The anchoring system for securing the strap to the in-molded helmet can further comprise the at least one clip of the bar tack clip interlocking with the strap anchor to prevent the bar tack clip from being pulled out of, or away from, the anchor housing. The at least one clip of the bar tack clip can comprise two side clips. The at least one clip of the bar tack clip can be disposed at an in-bound side of the bar tack clip, the in-bound side being perpendicular to sides of the bar tack clip. The strap can be coupled to the bar tack clip without an overmolded webbing clip. The strap anchor, the bar tack clip, and the strap can be adapted to be mounted to an out-bound side of the helmet, wherein the out-bound side of the helmet is oriented away from a head of a user. A pass-through can be formed at a lower edge of the bar tack clip and aligned with the cross beam, the pass-through being sized to receive a portion of the strap.

In another aspect, an anchoring system for securing a strap to an in-molded helmet can comprise a strap anchor, a bar tack clip sized to fit partially within the anchor housing, and a strap looped around the cross beam and coupled to itself. The bar tack clip can comprise a cross beam, and at least one clip coupled to the cross beam and sized to mateably couple with the strap anchor.

The anchoring system for securing the strap to the in-molded helmet can further comprise the at least one clip of the bar tack clip comprising two side clips. The at least one clip of the bar tack clip can be disposed at an in-bound side of the bar tack clip, the in-bound side being perpendicular to sides of the bar tack clip. The strap can be coupled to the bar tack clip without a pin. The strap anchor can further comprise an in-molding flange comprising a net shaped geometry comprising a solid outer perimeter and at least one inner open area surrounded by the solid outer perimeter. The strap anchor can be disposed within an energy management material of the in-molded helmet so that the bar tack clip, cross beam, and strap anchor are not visible to a user from an outside of the completed in-molded helmet. The at least one clip of the bar tack clip can interlock with the strap anchor to prevent the bar tack clip from being pulled out of, or away from, the strap anchor. The strap anchor, the bar tack clip, and the strap can be mounted to an out-bound side of the helmet, wherein the out-bound side of the helmet is oriented away from the head of the user.

In another aspect, a method of coupling a strap to an in-molded helmet can comprise in-molding a strap anchor into a protective helmet shell with an opening in the strap anchor exposed with respect to the protective helmet shell, providing a bar tack clip comprising a cross beam, looping a strap around the cross beam and coupling the strap to itself, and inserting the bar tack clip into the opening of the strap anchor after the strap anchor has been in-molded into the protective helmet shell to couple the bar tack clip to the strap anchor.

The method of coupling the strap to the in-molded helmet can further comprise the strap anchor being in-molded in an expanded foam energy management layer. The method of coupling the strap to itself further comprising sewing an end of the strap to a central portion of the strap to form a bar tack. The method can further comprise coupling the bar tack clip to the strap anchor by interlocking load bearing members disposed on sides of the strap anchor with side clips of the bar tack clip. The method can further comprise coupling the bar tack clip to the strap anchor by interlocking a clip disposed at an in-bound side of the bar tack clip with the strap anchor. The method can further comprise passing the strap through a pass-through at a lower edge of the bar tack clip, the pass-through being aligned with the cross beam.

DETAILED DESCRIPTION

Figure 1:
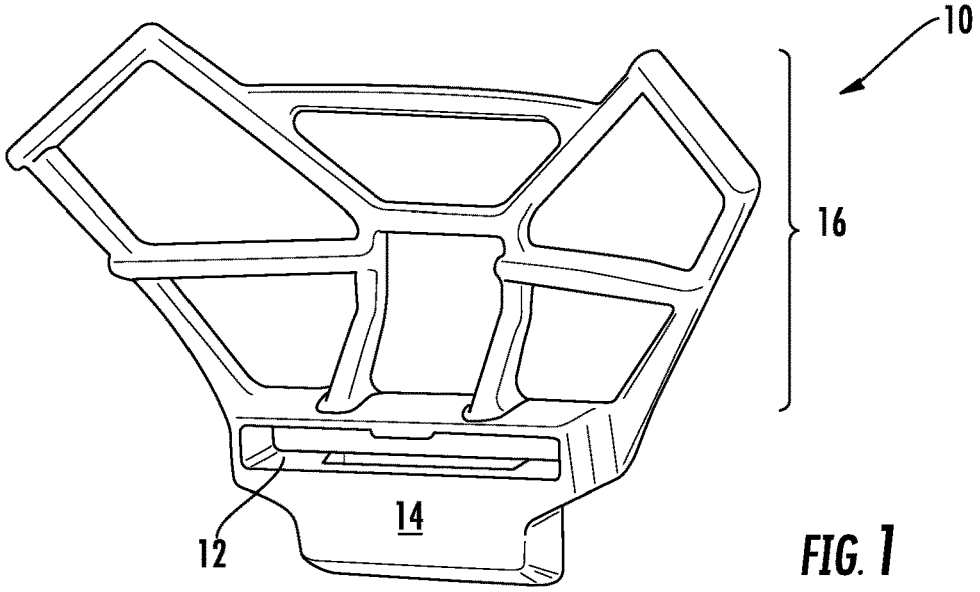
FIG. 1 PRIOR ART
FIG. 1 shows a view of a ski-type anchor device as known in the prior art.

This disclosure, its aspects and implementations, are not limited to the specific helmet or material types, or other system component examples, or methods disclosed herein. Many additional components, manufacturing and assembly procedures known in the art consistent with helmet manufacture are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail, particular embodiments with the understanding that the present disclosure is to be considered as an exemplification of the principles of the disclosed methods and systems, and is not intended to limit the broad aspect of the disclosed concepts to the embodiments illustrated.

This disclosure provides a device, apparatus, system, and method for providing a protective helmet that can include an outer shell and an inner energy-absorbing layer, such as foam. The protective helmet can be a bike helmet used for mountain biking or road cycling, as well as be used for a skier, skater, hockey player, snowboarder, or other snow or water athlete, a football player, baseball player, lacrosse player, polo player, climber, auto racer, motorcycle rider, motocross racer, sky diver or any other athlete in a sport. Other industries also use protective headwear, such that individuals employed in other industries and work such as construction workers, soldiers, fire fighters, pilots, or types of work and activities can also use or be in need of a safety helmet, where similar technologies and methods can also be applied. Each of the above listed sports, occupations, or activities can use a helmet that includes either single or multi-impact rated protective material base that is typically, though not always, covered on the outside by a decorative cover and includes comfort material on at least portions of the inside, usually in the form of comfort padding.

Generally, protective helmets, such as the protective helmets listed above, can comprise an outer shell and in inner energy-absorbing material. For convenience, protective helmets can be generally classified as either in-molded helmets or hard shell helmets. In-molded helmets can comprise one layer, or more than one layer, including a thin outer shell, an energy-absorbing layer or impact liner, and a comfort liner or fit liner. Hard-shell helmets can comprise a hard outer shell, an impact liner, and a comfort liner. The hard outer shell can be formed by injection molding and can include Acrylonitrile-Butadiene-Styrene (ABS) plastics or other similar or suitable material. The outer shell for hard-shell helmets is typically made hard enough to resist impacts and punctures, and to meet the related safety testing standards, while being flexible enough to deform slightly during impacts to absorb energy through deformation, thereby contributing to energy management. Hard-shell helmets can be used as skate bucket helmets, motorcycle helmets, snow and water sports helmets, football helmets, batting helmets, catcher's helmets, hockey helmets, and can be used for BMX riding and racing. While various aspects and implementations presented in the disclosure focus on embodiments comprising in-molded helmets, the disclosure also relates and applies to hard-shell helmets.

An improvement to both the traditional strap anchors 10 and the shell-mounted anchors 20 is the subject of the present disclosure, and for convenience can be referred to as a bar tack clip or as a bar tack clip strap anchor method. The method and device disclosed herein can provide a number of advantages with respect to strap anchor 10 and the shell-mounted anchor 20, which are discussed in greater detail below.

The method and device disclosed herein can take several forms, a number of non-limiting examples of which are provided below. As presented in the following examples, and as shown in FIGS. 3-5I, the bar-tack clip comprises a novel, non-obvious, and useful bar tack clip that can be coupled to a strap or piece of webbing, which in turn can be coupled to a strap anchor or strap anchor housing.

Figure 3:
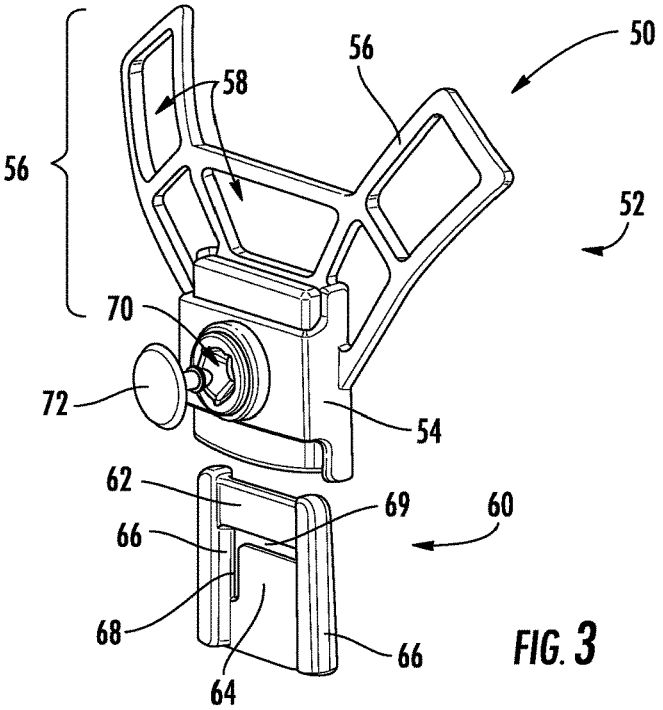
FIG. 3 shows a perspective view of an embodiment of an anchoring system.

FIG. 3 shows a bar tack anchoring system 50 for securing webbing or a strap to an in-molded helmet comprising a strap anchor 52. The strap anchor 52 can further comprise an anchor housing 54 and in-molding flanges, web, reinforcing attachment, fins, parachutes, anchoring geometry, or reinforcing attachment point 56. The in-molding flanges 56 can be formed as webs or nets, which includes opening or voids 58, that extend or are disposed away from the anchor housing 54, as shown in FIG. 3. The bar tack anchoring system 50 can also include a bar tack clip 60, an example of which is also shown in FIG. 3. A strap or webbing can be coupled to the bar tack clip 60 by sewing or with a bar tack as shown described in greater detail below with respect to FIGS. 4 and 5A-5I.

In some embodiments, the in-molding flanges 56 can be integrally formed with the anchor housing 54, and formed at a same time and of a same material as the anchor housing 54. The in-molding flanges 56 and the anchor housing 54 can be made of any suitable structural material, such as plastic, metal, ceramic, cellulose, textiles, fiberglass, carbon fiber, other fiber, rubber, polymers, or other similar materials. Possible plastics include thermoplastic elastomers (TPE), Polyolefins, Polyethylene (PE), Polyethylene terephthalate (PETE), Polypropylene (PP), Polyetherimide (PET), and Polyethersulfone (PES), polyvinyl chloride (PVC), vinyl nitrile (VN), Melamine, Nylon, Acetal, Styrene Ethylene Butylene Styrene (SEBS), Isoprene Copolymers, Styrene, Polycarbonate, or other similar material. When the strap anchor 52 is coupled to a helmet or in-molded helmet, the in-molding flanges 56 of the strap anchor 52, as well as the anchor housing 54, can be disposed within an energy-absorbing material or layer of the helmet. The in-molding flanges 56 can be sufficiently large, and include sufficient anchoring geometry, to secure the strap anchor 52 to the helmet by fixing at least the in-molding flanges 56 within the energy-absorbing material to remain firmly coupled to the helmet during impacts. Thus, when the bar tack anchoring system 50 is coupled to a helmet body, the in-molding flanges 56, as well as all or part of the anchor housing 54, can be imbedded within the helmet body. With the in-molding flange 56 disposed within the helmet body, the in-molding flange 56 can be used to distribute force applied to the strap anchor 52 from the bar tack clip 60 (such as tension from the webbing 80) to the surrounding helmet body. The strap anchor 52 can be disposed within an energy management material similar or identical to the energy management material 23 of an in-molded helmet that can be similar or identical to the in-molded helmet 25 so that the strap anchor 52, the bar tack clip 60, and the cross beam 62 are not visible to a user from an outside of the completed in-molded helmet. The energy management material 23 can be one or more layers of expanded polypropylene (EPP), expanded polystyrene (EPS), expanded polyolefin (EPO), or other similar or suitable material.

The anchor housing 54 of the strap anchor 52 shown in FIG. 3 differs from the strap anchor body 14 of traditional strap anchor 10 and the shell-mounted anchor 20 by being configured to be securely coupled to the bar tack clip 60. The bar tack clip 60 can be formed of a material that is similar or identical to the material forming anchor housing 54 and in-molding flanges 56. The bar tack clip 60 can comprise a cross beam 62 around which webbing or strap 80 can be disposed and a bar tack 82 can be sewn into the webbing 80 to form a loop of webbing 84. The bar tack clip 60 can also comprise a clip, barb, prong, tine, engagement tab, or interlocking engagement beam 64 that prevents the bar tack clip 60 from being inadvertently pulled out or away from the anchor housing 54 after having been inserted into the anchor housing 54. The clip 64, like the bar tack clip 60 or the face of the bar tack clip 60 around the clip 64, can be disposed at an in-bound side of the bar tack clip 60, the in-bound side being perpendicular to sides of the bar tack clip and oriented towards an interior of the helmet or towards an opening in the helmet for a user's head.

Both the cross beam 62 and the clip 64 can comprise a horizontal orientation with opposing ends of the cross beam 62 and opposing ends of the clip 64 being coupled to connecting members or vertical connecting members 66 disposed on opposing edges of the bar tack clip 60. The cross beam 62 and the connecting members 66 can be rigidly and integrally coupled to provide a solid and robust structure that can be inserted within the anchor housing 54. The clip 64 and the connecting members 66 can also be integrally formed, and the clip 64 can be coupled to the connecting members 66 in such as way so as to provide a solid and robust connection, while also allowing the clip 64 to flex and be temporarily moved or deformed during insertion into the anchor housing 54, the clip 64 then return to a normal or at rest position once inserted into the anchor housing 54 to lock in place or be mateably coupled with the anchor housing 54. One or more gaps, openings, or channels 68 that are formed along portions of the clip 64, such as between the clip 64 and the connecting members 66 can provide the flexibility of the clip 64.

As such, the bar tack clip 60 can be disposed within an opening in the strap anchor 52 or anchor housing 54, after the strap anchor 52 has been disposed within a helmet, such as an EPS foam layer of a helmet. After insertion of the bar tack clip 60 into the strap anchor 52, the webbing or strap 80 can function to hold the helmet to the head of a user, and an overall aesthetic of the helmet can also be improved, while maintaining functionality, by having the bar tack clip 60 and its cross beam 62, as well as the strap anchor 52, disposed within the helmet so that they are not visible to a user from an outside of the completed helmet.

The present anchoring system and device can also additionally include other features that are optional. A first optional feature can be a rivet opening 70 that can be formed in an outer surface of the strap anchor 52. The rivet opening 70 can be configured to receive a decorative rivet 72 that can be disposed and coupled to the rivet opening 70 to be visible on an outer surface of the in-molded helmet. The rivet 72 can provide structural support for fastening the bar tack clip 60 to the strap anchor housing 54, or can not provide any structural support for fastening the bar tack clip 60 to the strap anchor housing 54, providing instead a desired aesthetic or look.

A second optional feature of the anchoring system 50 includes the anchoring system 50, or portions thereof, being mounted to an out-bound side of the helmet, or the side of the helmet that is oriented away from a head of the user or does not touch the head of the user. Thus, the strap anchor 52 of the anchoring system 50 can differ from traditional or conventional anchors, such as strap anchor 10, in which the primary mechanism of the strap anchor is located on the inside surface of the helmet. Similarly, the strap anchor 52 of the anchoring system 50 can also differ from shell mounted anchor 20, in which the shell mounted anchor 20 is exposed at the bottom of plastic shell 22, and is centered within the energy absorbing material of the helmet. In contrast to traditional strapping methods from ski helmets, the bar tack anchoring system 50 can include a portion of the anchor housing 54 mounted or disposed on the outside of the helmet to provide a visual aesthetic similar to some shell style helmets in which straps are mounted to an outside of the helmet, while at the same time providing a secure connection between the in-molding flanges 56 and the in-molded helmet.

Figure 4:
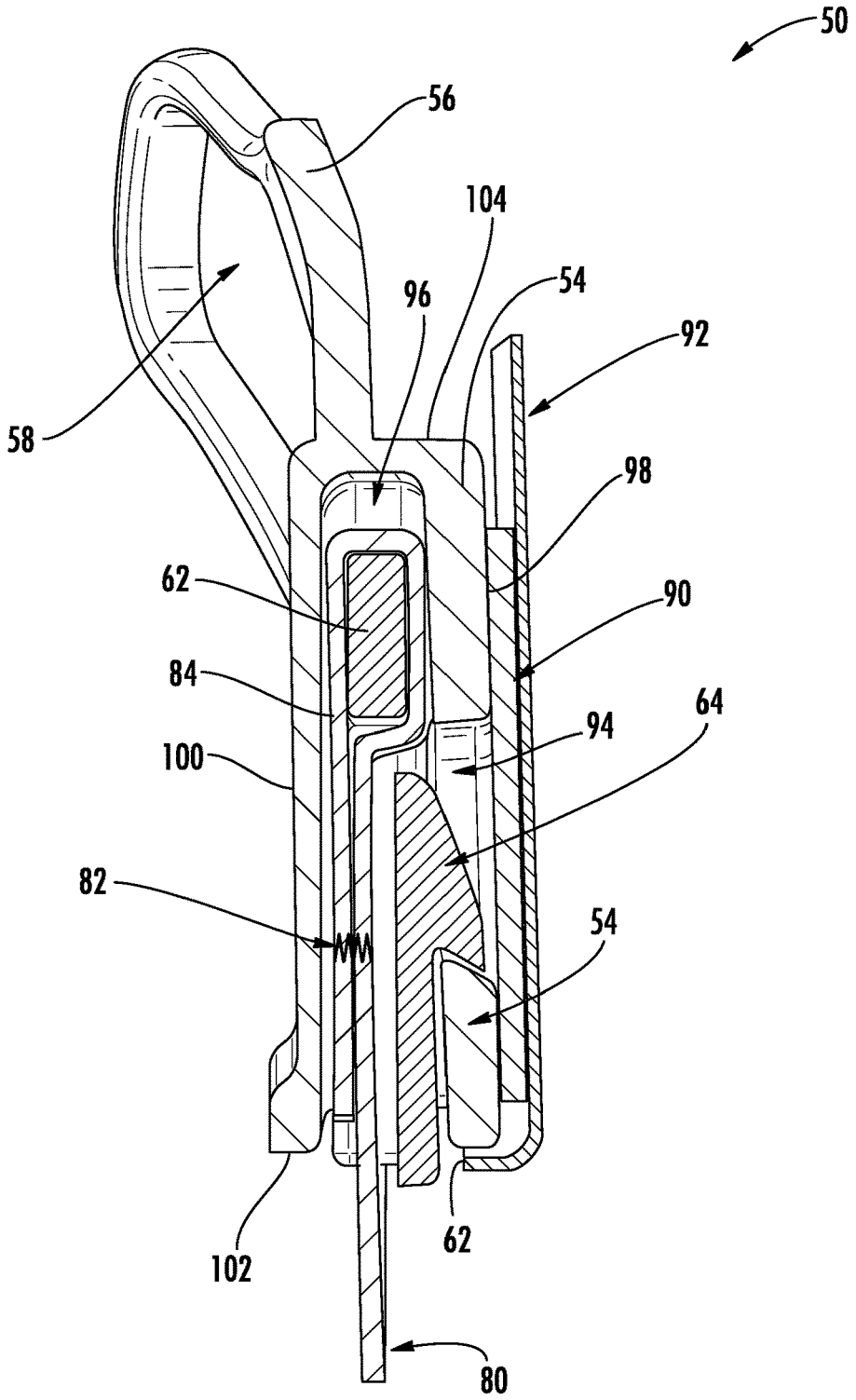
FIG. 4 shows a cross-sectional profile view of an embodiment of an anchoring system.

FIG. 4 shows an embodiment in which an optional adhesive 90, such as a tape or double-sided tape, can be affixed to both the strap anchor 52 and an underside or inner surface of an outer shell or cap 92 of an in-molded helmet, similar to shell 22. The adhesive 90 can hold the strap anchor 52 in place with respect to an outer helmet shell during the in-molding process. Use of the adhesive 90 can be in addition to, or in place of, use of the rivet 72 and a punched hole attachment. The adhesive 90 can also cover, protect, and prevent in-molding material, such as EPS foam or other material, from entering a first space or opening 94, as well as a second space or opening 96, into which the bar tack clip 60 will be disposed. In some embodiments, the adhesive 90 can comprise a thickness in a range of 0.2-5.0 millimeters (mm), or about 1 mm. As used herein, the term "about" can refer to plus or minus up to 10%, 25%, or 50% of a stated value.

The bar tack anchoring system 50 shown in FIGS. 3-5I, like the bar tack anchoring system 150 shown in FIGS. 6A-6E, illustrate that a number of configurations and variations in the shape, structure, and form of the bar tack anchoring system are contemplated and encompassed by the present disclosure. For example, the anchor housing 54 can be of any desirable shape or size that is configured to receive, or is mateably compatible with, the corresponding bar tack clip 60. The anchor housing 54 can comprise 6 sides or surfaces, or any number of sides or surfaces, including four and five sides or surfaces, such as the five-sided or 5-surfaced anchor housing 54 shown in FIG. 4. Alternatively, the anchor housing 54 of FIG. 4 can also be considered a six-sided anchor housing with an open sixth side or bottom side, through which the bar tack clip 64 will enter. An outer profile, shape, or envelope of the anchor housing 54 can comprise a rectangular prism, a box, a polygon, or any other solid or hollow shape. Accordingly, the anchor housing 54 can be considered a hollow box with one or more spaces or openings, such as first space 94 and second space 96, which can go partially or completely through a volume or one or more surfaces of the anchor housing 54.

As shown in FIG. 4, the first space or opening 94 can extend partially but not completely or entirely through the anchor housing 54, so that the first space 94 passes through a first surface 98 oriented towards an interior of the helmet without passing through a second surface 100 of the anchor housing 54 opposite the first surface 98, the second surface 100 being oriented towards an exterior of the helmet.

The second space or opening 96 can also extend partially but not completely or entirely through the anchor housing 54. The second space 96 can extend from a third surface 102, the third surface 102 being at a bottom edge of the helmet and oriented in a direction away from a bottom of the helmet and also being positioned or oriented in a direction that is perpendicular, transverse, or substantially perpendicular or transverse to the first surface 98, the second surface 100, or both. The second space 96 can extend into the anchor housing 54 without extending through a fourth surface 104, the fourth surface 104 being opposite the third surface 102, the fourth surface 104 also being positioned or oriented in a direction that is perpendicular, transverse, or substantially perpendicular or transverse to the first surface 98, the second surface 100, or both.

The first space 94 and the second space 96 can intersect with each other to provide an opening, void, or the inner space within the anchor housing 54 to receive the bar tack clip 60. While the space for receiving the bar tack clip 60 has, for convenience, been described as an intersections of two separate spaces, first space 94 and second space 96, the space for receiving the bar tack slip 60 can also be described or thought of as a single space or void with intersections or openings through the first surface 98 and the third surface 102. In either event, the bar tack clip 60 can be inserted into the anchor housing 54 through the first space 96 with the clip 64 being flexibly deformed to fit through the first space 94. The clip 64 of the bar tack clip 60 can then return to an at rest position to extend into, or through, the second space 96 to releasably or permanently couple the clip 64 with the second space 96. As such, the bar tack clip 60 can be coupled within the strap anchor 52 to allow the bar tack anchoring system 50 to couple the webbing 80 to a helmet, and to allow the user to couple the helmet to the head of the user.

The bar tack anchoring system 50 can couple the webbing 80 to a helmet, as indicated above, by coupling the webbing 80 to the bar tack clip 60 by sewing or placing a bar tack 82 into the webbing 80 to form the loop of webbing 84 that is disposed around, and coupled to, the cross beam 62. A non-limiting example of attaching the webbing 82 to the bar tack clip 60, such as by sewing, is described herein with respect to FIGS. 5A-5I.

Figure 5A:
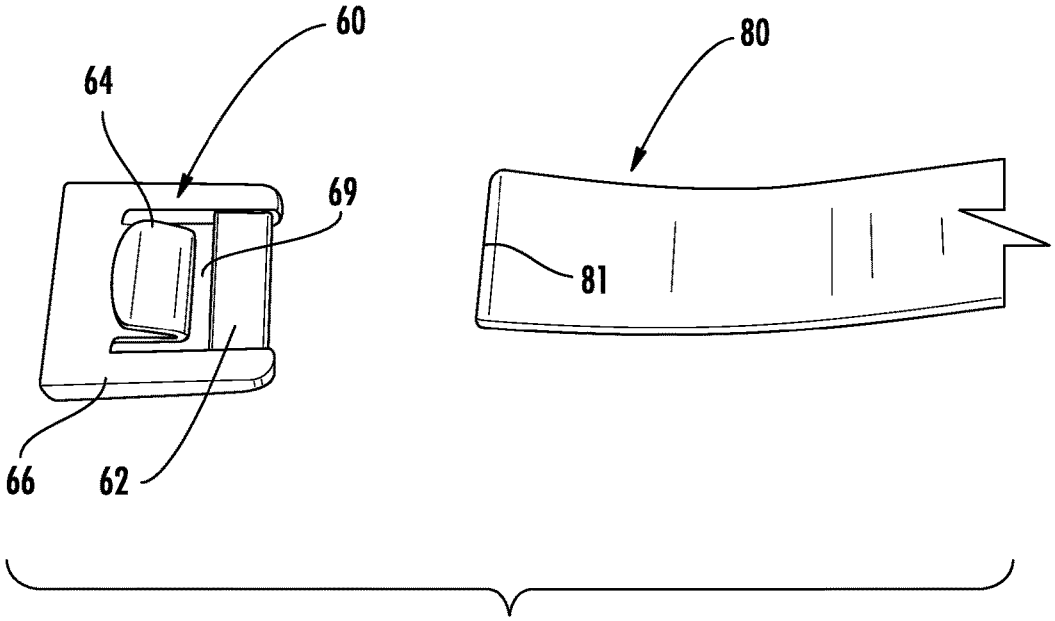
FIGS. 5A-5I show various views of a strap being coupled to an embodiment of a bar tack clip.

FIG. 5A shows an example of a bar tack clip 60 comprising a clip 64 at a central area of the bar tack clip 60 and a cross beam 62 at a top or leading edge of the bar tack clip 60, although the relative position of the clip and the cross beam could be moved relative to each other in various embodiments. The cross beam 62 of the bar tack clip 60 is shown oriented towards the webbing 80, with an end 81 of the webbing 80 being offset from the bar tack clip 60 before being threaded through a top opening, gap, or channel 69 in the bar tack clip 60 and around the cross beam 62.

Figure 5B:
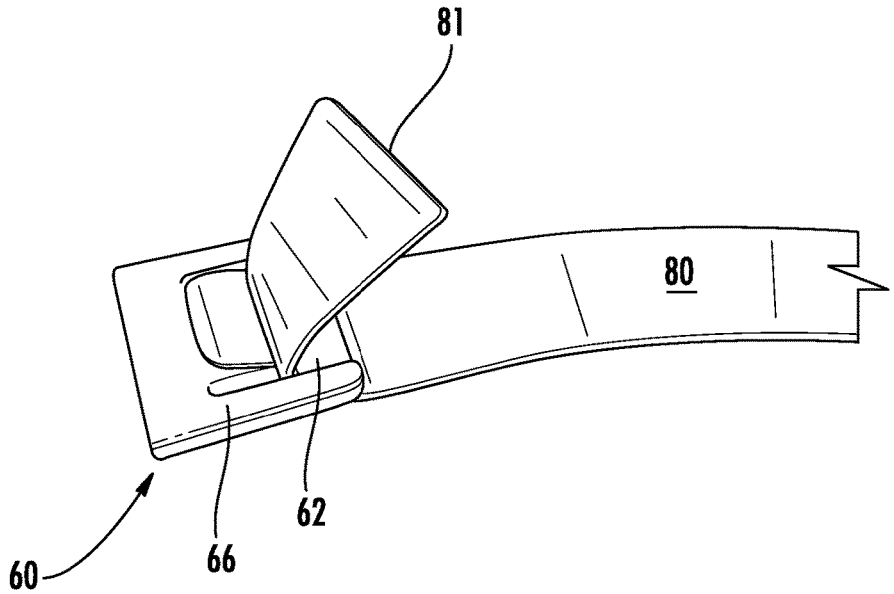

As shown in FIG. 5B, the end 81 of the webbing 80 can be threaded through the top opening 69 and around the cross beam 62, the opening 69 being adjacent the cross beam 62. In some instances, a side or portion of the cross beam 62 can define a side or portion of the opening 69. Both the cross beam 62 and the opening 69 can be sized for receiving the webbing 80 so that a loop 84 of webbing 80 can be formed around the cross beam 62. The opening 69 can be adjacent the cross beam 62, and in some instances, a side or portion of the cross beam 62 can define a side or portion of the opening 69.

Figure 5C:
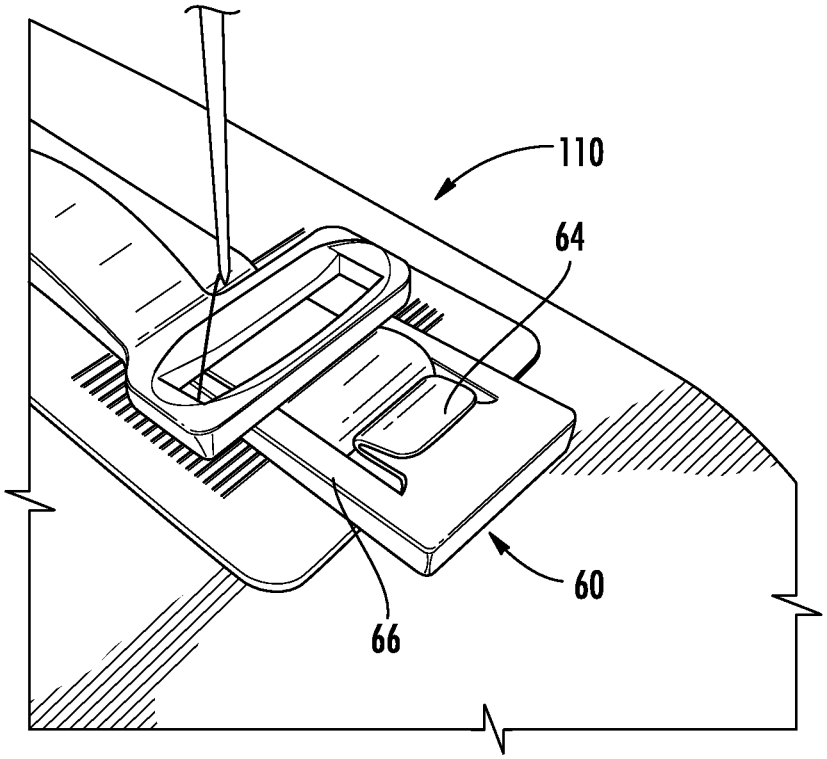
Figure 5D:
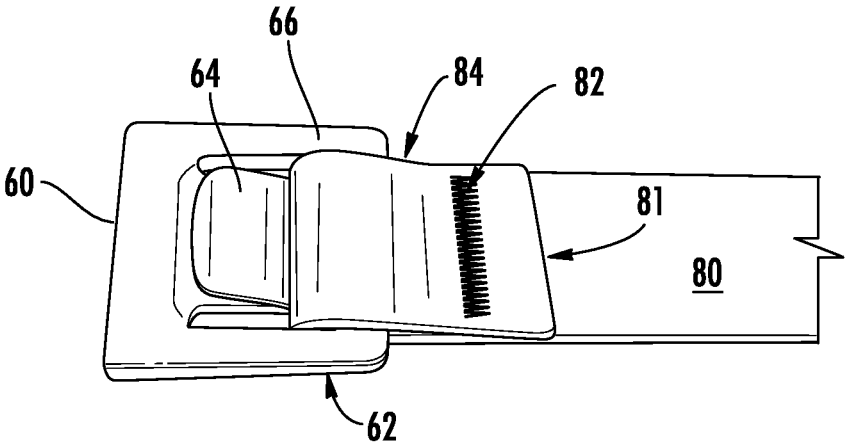

After inserting the webbing 80 through the opening 69, the webbing 80 can be folded back across the cross beam 62. The webbing 80 can then be sewn or bar-tacked on a sewing machine 110, as shown in FIG. 5C, to form the loop of webbing 84, shown in FIG. 5D. The loop of webbing 84 can be sewn with the bar tack 82 passing through the webbing 80 near the end 81 of the webbing 80, as well as passing through a central portion of the webbing 80 that is disposed away from the end 81 of the webbing 80. Creating the loop of webbing 84 around the cross beam 62 to couple the webbing 80 to the bar tack clip 60 is less time consuming and less costly than in-molding a plastic clip geometry, like strap anchor over-mold clip 24, to the end 81 of the webbing 80.

Figure 5E:
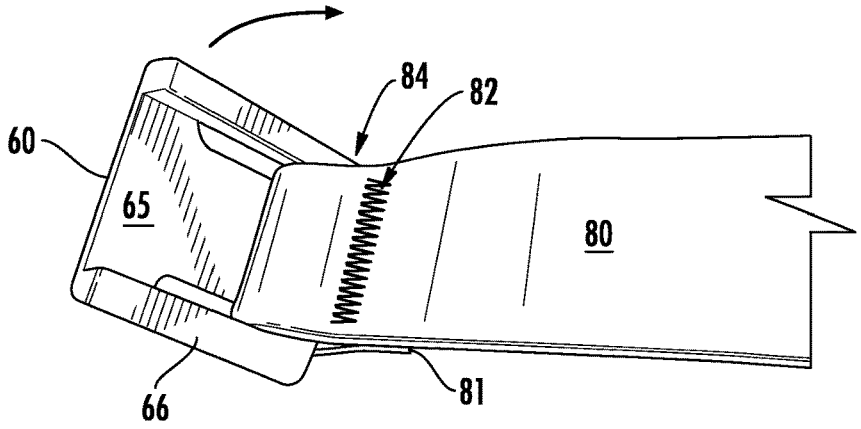
Figure 5F:
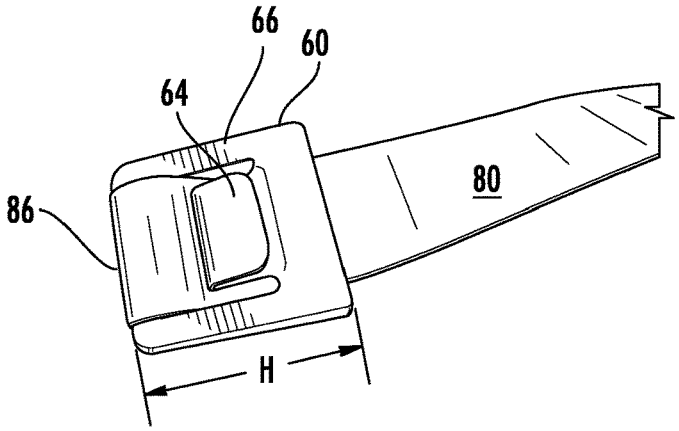

As shown in FIG. 5E, after sewing the loop of webbing 84 around the cross beam 62, the bar tack clip 60 can then be folded over the bar tack 82 and a portion of the webbing 80 so that a surface 65 of the bar tack clip 60 that is opposite the clip 64 can be adjacent or in contact with a surface of the webbing 80. As shown in FIG. 5F, a portion of the webbing 80 disposed over the cross beam 62 can form a leading edge 86 of the webbing 80 that covers a top of the bar tack clip 60. While the relative movement of the bar tack clip 60 and webbing 80 can be described, or thought of, in terms of moving the bar tack clip 60 with respect to the webbing 80, the opposite can also be true so that the webbing 80 is moved with respect to the bar tack clip 60. As such, the webbing 80 can be moved relative to the bar tack clip 60 so that the webbing 80 and the bar tack 82 can be folded over, and be place adjacent or in contact with, the surface 65 of the bar tack 60. In either event, the movement of the webbing 80, the bar tack clip 60, or both, can result in a tail or length 88 of webbing 80 disposed along a height $H_1$ of the bar tack clip 60 and extending away from the cross beam 62. The tail or length 88 of webbing 80 can be subsequently used for coupling the helmet to a user's head.

Figure 5G:
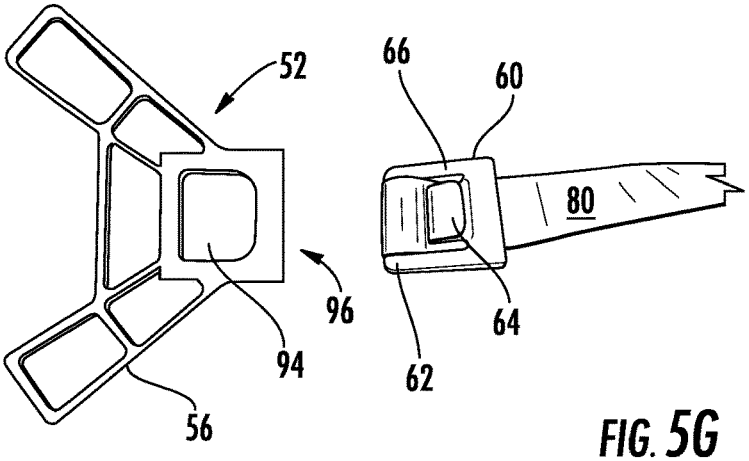

FIG. 5G, continuing from FIG. 5F, shows the bar tack clip 60 ready for insertion into the strap anchor 52 or strap anchor housing 54. The bar tack clip 60 and the webbing 80 is shown aligned with the cross beam 62 of the bar tack clip 60 oriented towards, and aligned with, the opening 96 in the anchor housing 54. The clip 64 of the bar tack clip 60 is also oriented so that the bar tack clip 60 will be mateably coupled with the opening 94.

Figure 5H:
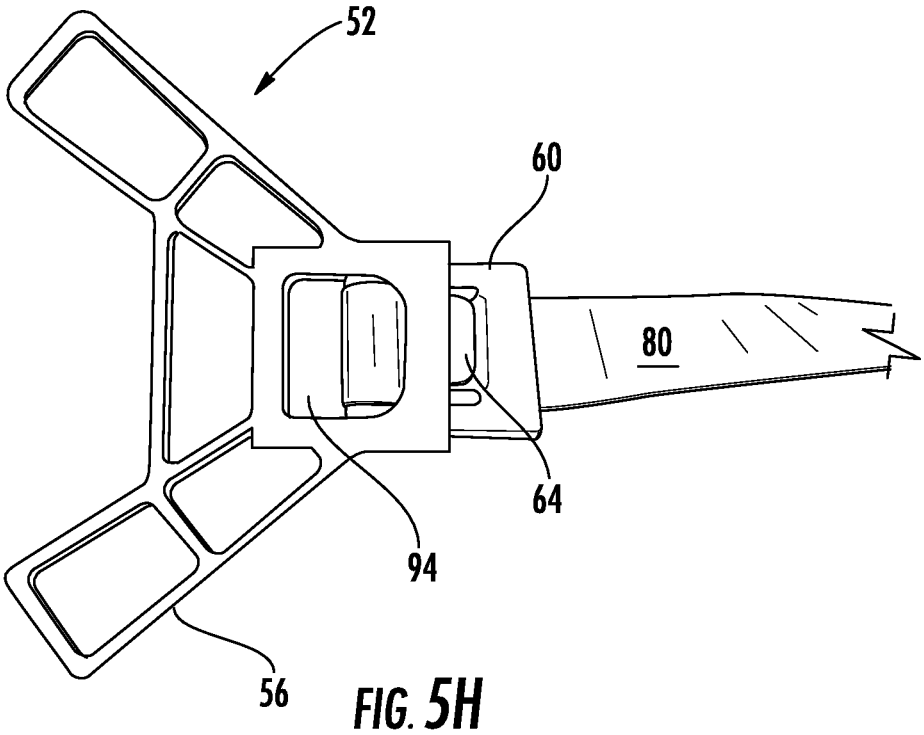

FIG. 5H, shows that after the bar tack clip 60 is aligned with the strap anchor 52 or strap anchor housing 54, the bar tack clip 60 and the webbing 80 coupled around the cross beam 62 are inserted into strap anchor housing 54 and are releasably coupled to the strap anchor 52. FIG. 5H shows the bar tack clip 60 partially inserted into the strap anchor 52.

Figure 5I:
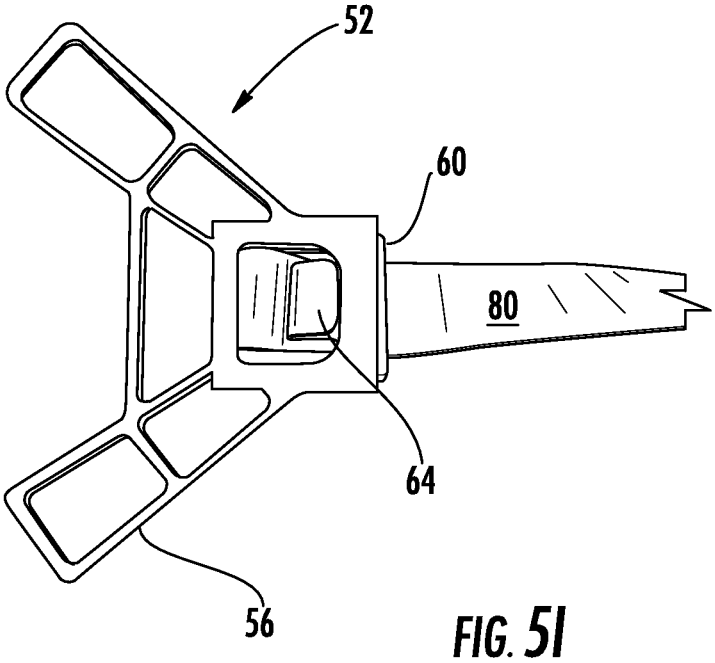

FIG. 5I, shows the bar tack clip 60 fully engaged with the strap anchor 52 so that the clip 64 of the bar tack clip 60 is disposed within the opening 94 of the bar tack clip 60. The clip 64 is firmly in contact with the anchor housing 54 to resist or prevent the bar tack clip 60 from being removed from the anchor housing 54 when tension is applied to the webbing or strap 80 to pull the webbing 80 and bar tack clip 60 away from the strap anchor 52, such as during an impact or crash in which the user is wearing the helmet.

Figure 2A:
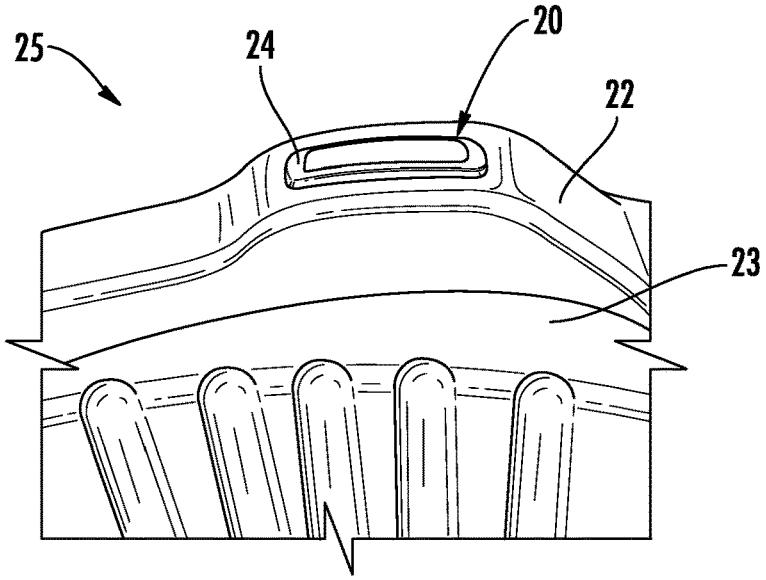
FIG. 2A PRIOR ART
FIGS. 2A-2D show various views of an embodiment of a shell-mounted anchor.
Figure 2B:
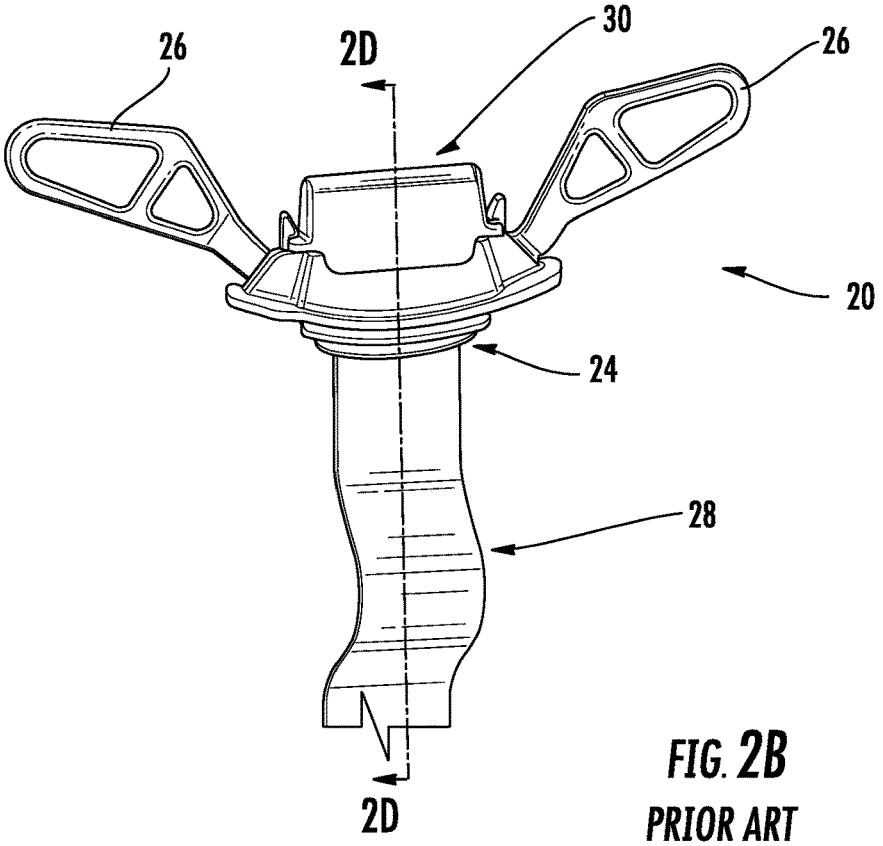
FIG. 2B PRIOR ART
Figure 2C:
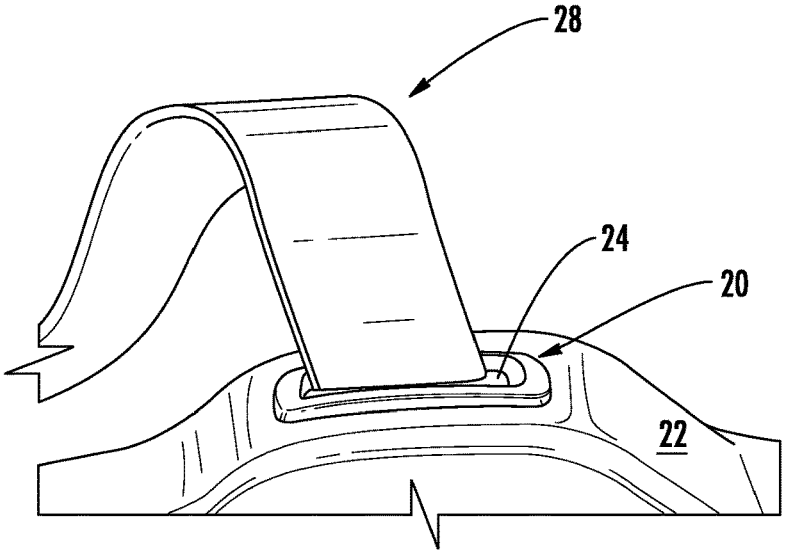
FIG. 2C PRIOR ART
Figure 2D:
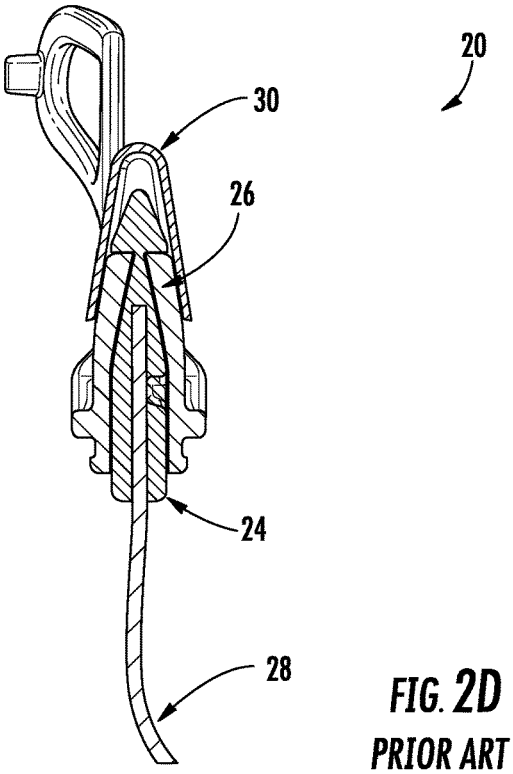
FIG. 2D PRIOR ART

For clarity, FIGS. 5G-5I show a representation of the strap anchor 52, including the in-molding flanges 56, outside of a helmet. In actual use however, the strap anchor 52 can be mostly, or entirely, concealed from view by being buried or imbedded within the helmet, such as in a layer of EPS foam. In some instances, the one or more strap anchors 52 will be disposed within the helmet at side or lateral portions of the helmet, such as at lower edges the helmet that can be the same or similar to the position of shell-mounted anchor or housing 20 shown in FIG. 2A. In any event, a method of coupling webbing 80 to an in-molded helmet can comprise in-molding strap anchor 52 into a protective helmet or helmet shell with the opening 96 in the strap anchor 52 exposed with respect to the protective helmet shell or helmet. The method can further include, a bar tack clip 60 comprising a cross beam 62 being provided, a webbing 80 being sewn to, or around, the cross beam 62, and the bar tack clip 60 being inserted into the opening 96 of the strap anchor 52 to permanently or releasably couple the bar tack clip 60 to the strap anchor 52.

By attaching the webbing or strap 80 to the bar tack clip 60 with a sewn bar tack 82, the webbing 80 and bar tack clip 60 can be coupled to, and inserted into, the anchor housing 54 after in-molding the anchor housing 54 into the in-molded energy absorbing material of the in molded helmet. Thus, the complication of including the bar tack clip 60 and the webbing 80 in the in-molding process, or attached to the strap anchor 52 or the helmet during the in-molding process can be avoided. Before in-molding the in-molded helmet, the anchor housing 54 can be coupled to a mold or to a shell into which the in-molded helmet will be formed, such as a polycarbonate vacuum formed shell that can be similar to the plastic shell 22 shown in FIG. 2A. In some embodiments, strap anchors 52 including in-molding flanges 56, anchor housings 54, or both, can be snapped into or punched through a portion of the shell, such as a cut-out, void, hole, or opening in the shell. Alternatively, the strap anchor 52 may also be seated on a blade or post in the in-molding tooling for in-molding of energy absorbing material, such as EPS tooling during the EPS forming process. While some variations of the strap anchor 52 will comprise rivets 72 and have portions of the strap anchor 52 exposed from the helmet, other variations or version of the strap anchor can be formed without rivets 72, including decorative rivets, and can be coupled to the shell before in-molding and hidden from view after molding by being disposed within the in-molded helmet. In other embodiments, the rivet 72 shown in FIG. 3 can be used to secure the strap anchor 52 to the shell before in-molding and the rivet 72 can remain visible from outside the shell of the helmet.

Figure 6A:
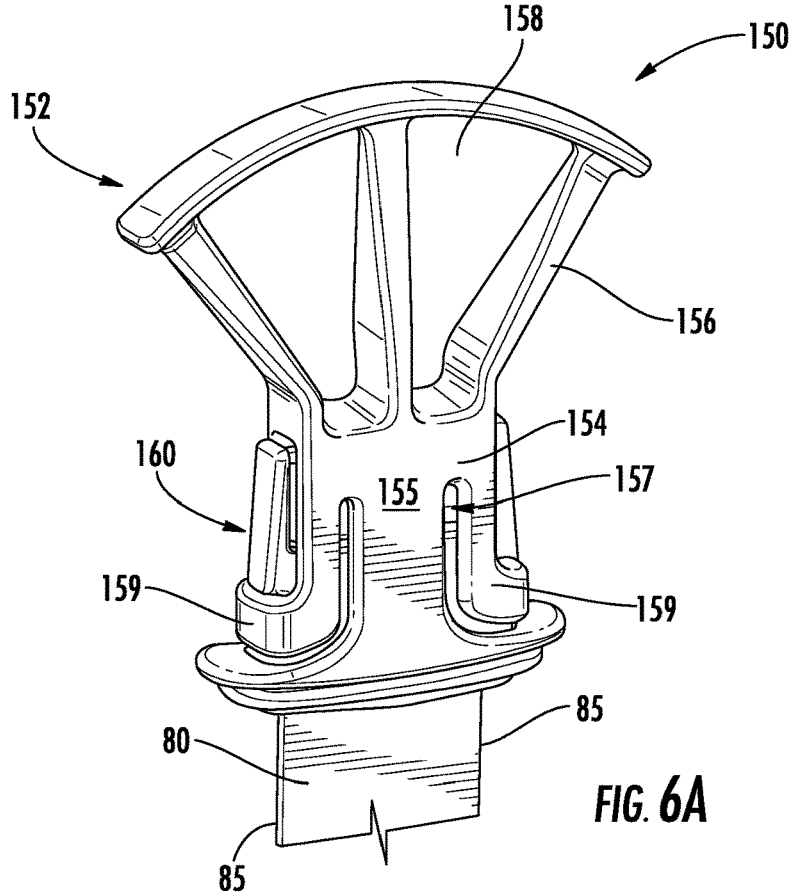
FIGS. 6A-6E shows various views of another embodiment of a shell-mounted anchor.

FIGS. 6A-6E include another embodiment of an anchoring system according to the present disclosure. FIG. 6A shows a non-limiting example of a bar tack anchoring system 150. The bar tack anchoring system 150 can comprise a webbing or strap 80, a strap anchor 152, an anchor housing 154, in-molding flanges 156, and a bar tack clip 160, each of which can be formed of a same material, a different material, or a similar material, including one or more of any suitable structural material, such as plastic, metal, ceramic, cellulose, textiles, fiberglass, carbon fiber, other fiber, rubber, polymers, or other similar materials. Possible plastics include TPE, Polyolefins, PE, PETE, PP, PET, PES, PVC, VN, Melamine, Nylon, Acetal, SEBS, Isoprene Copolymers, Styrene, Polycarbonate, or other similar material.

Figure 6B:
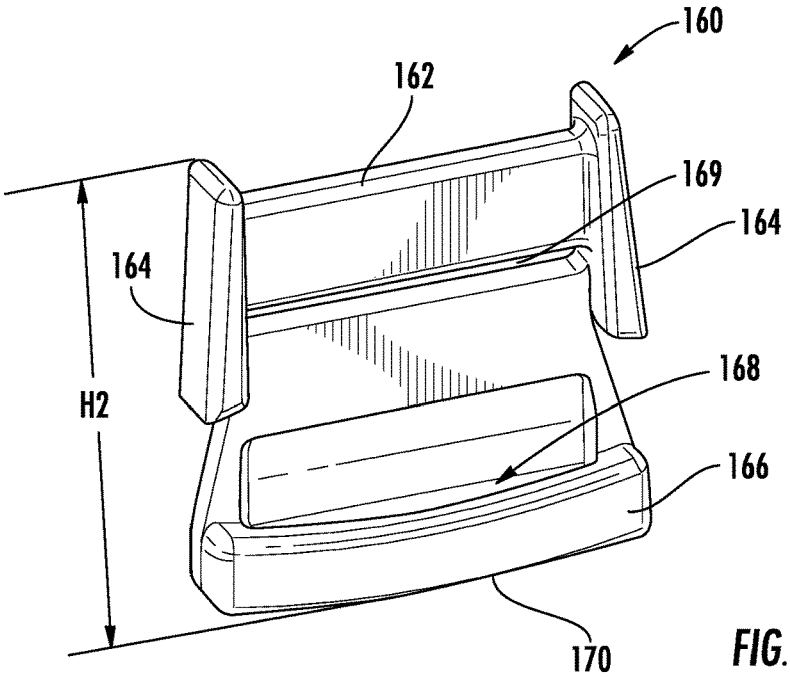

The bar tack clip 160 can further comprise one or more side clips, clips, barbs, prongs, tines, engagement tabs, or interlocking engagement pieces 164. The side clips 164 can be load bearing members that couple or are mateably joined with the strap anchor 152 for holding the strap anchor 152 to the bar tack clip 160 as part of the bar tack anchoring system 150 for holding a helmet to the wearer's head. The side clips 164 can differ from the clip 64 by both number and position. As shown in FIG. 6B, the bar tack clip 160 can comprise two side clips 164 that are disposed at sides or lateral regions of the bar tack clip 160, opposite each other, rather than on a front or back of the bar tack clip 160. In other words, the side clips 164 of the bar tack clip 160 can correspond, align with, or can be parallel or substantially parallel to a length or height of the webbing 80 or edges 85 of the webbing 80. Furthermore, the strap anchor 152 can comprise load bearing members or clips 159 that correspond to, couple with, and are mateably sized with the side clips 164 of the bar tack clip 160. The load bearing members 159 can be separated or offset from a central portion 155 of anchor housing 154 by openings or channels 157. The load bearing members 159 can also be flexibly or hingedly coupled to the anchor housing 154 above or at an end of the channels or openings 157. As such, the load bearing members 159 can be supported and cantilevered from above, rather than by being supported or cantilevered from below, as is the case with clip 64 shown in FIG. 3.

FIG. 6B, shows an enlarged view of the bar tack clip 160 separate from, and not coupled to, both the strap anchor 152 and the webbing 80. As shown in FIG. 6B, the bar tack clip 160 can comprise side clips 164 that are aligned with edges of the anchor housing 154 and edges 85 of the webbing 80 that is coupled or attached to the bar tack clip 160, rather than being aligned with the main surfaces or faces of the webbing 80 that are perpendicular to the edges 85. As such, the side clips 164 can be perpendicular, transverse, or aligned at a rotation of 90 degrees with respect to the clip 64 shown above in FIGS. 2A-5. FIG. 6B also shows that the cross beam 162 is sized for receiving the loop 84 of webbing 80 around the cross beam 162, the webbing 80 being further disposed through the opening 169 in the bar tack clip 160, the opening 169 being adjacent the cross beam 162. In some instances, a side or portion of the cross beam 162 can define a side or portion of the opening 169.

Figure 6C:
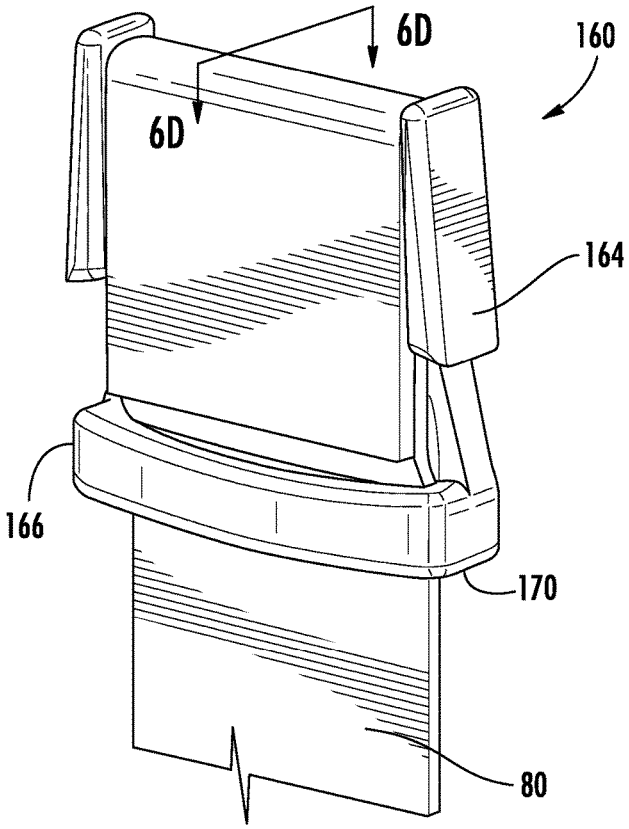

FIG. 6C, shows the bar tack clip 160 with the webbing 80 coupled to the bar tack clip 160 without being coupled to the strap anchor 152 as shown in FIG. 6A. The webbing 80 can be coupled to cross beam 162 of the bar tack clip 160 as described above with respect to the webbing 80 being coupled to cross beam 62 or bar tack clip 60 as shown in FIGS. 5A-5F. The bar tack clip 160 can optionally include an arch or support 166 that forms a pass-through or opening 166 for receiving or allowing a portion of the webbing 80 to extend from a first side of the pass-through 166 to a second side of the pass through 166 opposite the first side. The pass-through 166 can be disposed at a lower edge 170 of the bar tack clip 160 and aligned with the arch 166. As such, a portion of the webbing 80 seen by the user can be neatly bounded by a uniform portion of the lower edge 170 of the bar tack clip 160, such as a bead of plastic material. To the contrary, and without inclusion of the arch 166, the webbing 80 could be bounded on less than all sides, such as being bounded on only one side, or three sides, by the bar tack clip 160. FIG. 6C shows a non-limiting example of the side clips 164 coupled to the cross beam 162 at or near a top of the bar tack clip 160, although in various embodiments the side clips 164 can also be disposed at any lower point along the edges or sides of the bar tack clip 160.

Figure 6D:
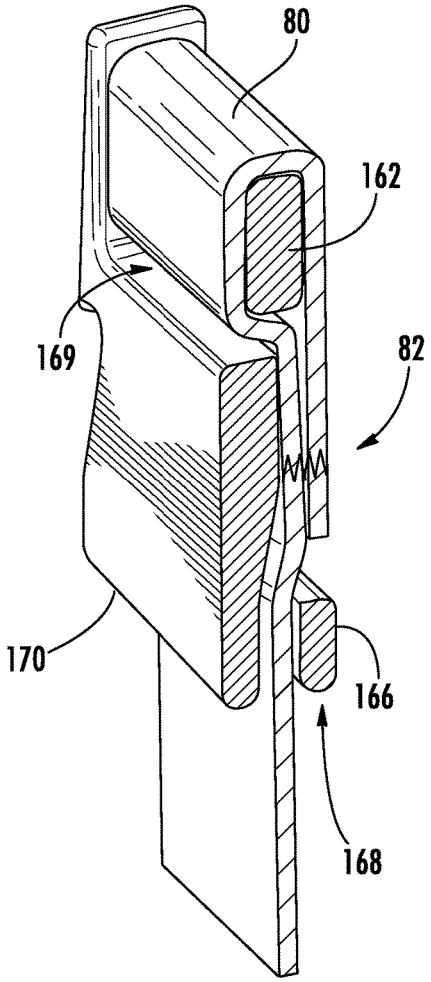

FIG. 6D, shows a cross-sectional perspective view of the bar tack clip 160 and webbing 80 and webbing taken along the line 1D shown in FIG. 6C. FIG. 6D also shows a path of the webbing 88 as it is looped around the cross beam 162, secured with bar tack 82, and disposed through the pass through 168.

Figure 6E:
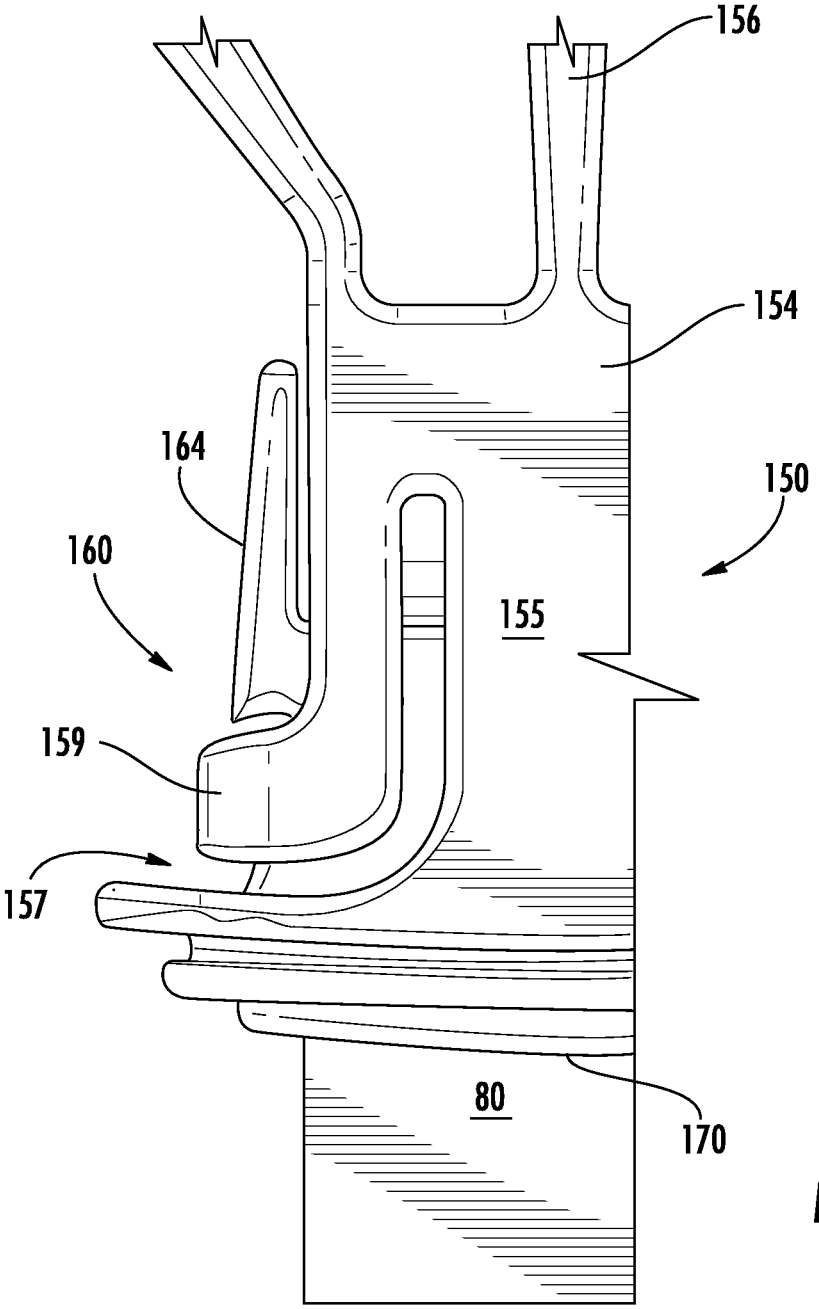

FIG. 6E shows a close-up profile view of a portion of the bar tack anchoring system 150 shown as the left central portion of the bar tack anchoring system 150 in FIG. 6A. FIG. 6E shows the bar tack clip 160 coupled to the strap 80 and disposed within the strap anchor housing 145. The left side clips 164 of the bar tack clip 160 is shown interlocked or mateably coupled with a left load bearing member 159. The flexible load bearing arms 159 of the strap anchor 152 can be moved, pushed, or deformed by the side clips 164 of the bar tack clip 160 as the bar tack clip 160 is inserted into the strap anchor housing 154. Alternatively, flexible side clips 164 of the bar tack clip 160 can be moved, pushed, or deformed by the load bearing members 159 of the strap anchor 152 as the bar tack clip 160 is inserted into the strap anchor housing 154. In either event, the side clips 164 and load bearing members 159 can engage, be mateably coupled, and be locked in place after advancing into the strap anchor 152.

For clarity, FIGS. 6A-6E show a representation of the strap anchor 152, including the in-molding flanges 156, outside of a helmet. In actual use however, the strap anchor 152 can be mostly, or entirely, concealed from view by being buried or imbedded within the helmet, such as in a layer of EPS foam. In some instances, the one or more strap anchors 152 will be disposed within the helmet at side or lateral portions of the helmet, such as at lower edges the helmet that can be the same or similar to the position of shell-mounted anchor or housing 20 shown in FIG. 2A. In any event, a method of coupling webbing 80 to an in-molded helmet can comprise in-molding strap anchor 152 into a protective helmet or helmet shell with the opening 168 in the strap anchor 152 exposed with respect to the protective helmet shell or helmet. The method can further include, a bar tack clip 160 comprising a cross beam 162 being provided, a webbing 80 being sewn to, or around, the cross beam 162, and the bar tack clip 160 being inserted into the opening 168 of the strap anchor 152 to permanently or releasably couple the bar tack clip 160 to the strap anchor 152.

By attaching the webbing or strap 80 to the bar tack clip 160 with a sewn bar tack 82, the webbing 80 and bar tack clip 160 can be coupled to, and inserted into, the anchor housing 154 after in-molding the anchor housing 154 into the in-molded energy absorbing material of the in molded helmet. Thus, the complication of including the bar tack clip 160 and the webbing 80 in the in-molding process, or attached to the strap anchor 152 or the helmet during the in-molding process can be avoided. Before in-molding the in-molded helmet, the anchor housing 154 can be coupled to a mold or to a shell into which the in-molded helmet will be formed, such as a polycarbonate vacuum formed shell that can be similar to the plastic shell 22 shown in FIG. 2A. In some embodiments, strap anchors 152 including in-molding flanges 156, anchor housings 154, or both, can be snapped into or punched through a portion of the shell, such as a cut-out, void, hole, or opening in the shell. Alternatively, the strap anchor 152 may also be seated on a blade or post in the in-molding tooling for in-molding of energy absorbing material, such as EPS tooling during the EPS forming process. Some variations of the strap anchor 152 can also comprise rivets. The strap anchor 152 can be disposed within an energy management material similar or identical to the energy management material 23 of an in-molded helmet that can be similar or identical to the in-molded helmet 25 so that the strap anchor 152, the bar tack clip 160, and the cross beam 162 are not visible to a user from an outside of the completed in-molded helmet.

Thus, while the specific shape and configuration of the strap anchor and bar tack clip can vary, multiple variations can include common features. Such common features can include a form of the insertion geometry and method for creating it. A method of forming an insertion member, e.g. the bar tack clip, without a need for over-molding a plastic part (such as the strap anchor over-mold clip 24 of FIGS. 2A-2D. An additional common feature can include the bar tack, once the clip is inserted into the strap anchor, being hidden inside the body of the strap anchor. Furthermore, each bar tack clip can comprise a beam opening over which the strap can be looped or passed. The strap anchor can have a corresponding interlocking clip or engagement beam that is mateably coupled to the clip of the bar tack clip.

Accordingly, the anchoring system described herein can provide an advantage over traditional methods for mounting strap anchor 10 by allowing for the mounting of the webbing system to be outbound instead of inbound, or way from an inner surface of the helmet adjacent a wearer's head. The anchoring system can further allow for attachment of mounting features on in-molded polycarbonate shell caps, like what is found on bike and snow helmets. The anchoring system can further allow for the use of a decorative rivet to provide an appearance or "look" of the rivet attachment to an outer shell such as an outer shell made of acrylonitrile butadiene styrene (ABS) or other similar material. Additionally, by forming the anchoring system as described herein, insertion of a webbing bar-tack slip after in-molding of the EPS can be accomplished, thus avoiding the complication of including the webbing assembly in the in-molding process.

For example, a difficulty of using the shell-mounted anchor 20 of FIGS. 2A-2D can be the over-molded clip 24 that is formed over and around an end of the webbing 28. Over-molding of the webbing 28 to form the over-mold clip 24 introduces a manufacturing process or step that requires additional time and expense. Furthermore, accommodating the strap-anchor over-mold clip 24 with a void or opening in the shell-mounted anchor 20 often includes the use of the cover 30 to prevent foam or in-molded material of the helmet, such as expanding polystyrene beads, from entering the void or opening in the shell-mounted anchor 20 and interfering with the strap-anchor over-mold clip 24 from engaging or interlocking with the shell-mounted anchor 20. Thus, while useful, inclusion of the cover 30 results in a more complicated device, and introduces another component or element that requires additional time and expense in manufacture and assembly.

Where the above examples, embodiments and implementations reference examples, it should be understood by those of ordinary skill in the art that other helmet and manufacturing devices and examples could be intermixed or substituted with those provided. In places where the description above refers to particular embodiments of helmets and customization methods, it should be readily apparent that a number of modifications may be made without departing from the spirit thereof and that these embodiments and implementations can be applied to other to helmet customization technologies as well. Accordingly, the disclosed subject matter is intended to embrace all such alterations, modifications and variations that fall within the spirit and scope of the disclosure and the knowledge of one of ordinary skill in the art.

What is claimed is:

1. An anchoring system for securing a strap to an in-molded helmet comprising:

a strap anchor comprising:

an anchor housing, and an in-molding flange coupled to the anchor housing and sized to hold the strap anchor within the in-molded helmet;

a bar tack clip sized to fit partially within the anchor housing, the bar tack clip comprising:

a cross beam, an opening adjacent the cross beam, and at least one clip coupled to the cross beam and sized to mateably couple with the anchor housing; and a strap disposed through the opening in the bar tack clip and looped around the cross beam, the strap being coupled to itself with a bar tack.

2. The anchoring system of claim 1, wherein the at least one clip of the bar tack clip interlocks with the strap anchor to prevent the bar tack clip from being pulled out of, or away from, the anchor housing.

3. The anchoring system of claim 2, wherein the at least one clip of the bar tack clip comprises two side clips.

4. The anchoring system of claim 2, wherein the at least one clip of the bar tack clip is disposed at an in-bound side of the bar tack clip, the in-bound side being perpendicular to sides of the bar tack clip.

5. The anchoring system of claim 1, wherein the strap is coupled to the bar tack clip without an overmolded webbing clip.

6. The anchoring system of claim 1, wherein the strap anchor, the bar tack clip, and the strap are adapted to be mounted to an out-bound side of the helmet, wherein the out-bound side of the helmet is oriented away from a head of a user.

7. The anchoring system of claim 1, further comprising a pass-through at a lower edge of the bar tack clip and aligned with the cross beam, the pass-through being sized to receive a portion of the strap.

8. An anchoring system for securing a strap to an in-molded helmet comprising:

a strap anchor comprising an in-molding flange coupled to the strap anchor and sized to hold the strap within the in-molded helmet, the in-molding flange comprising a net shaped geometry comprising a solid outer perimeter and at least one inner open area surrounded by the solid outer perimeter;

a bar tack clip sized to fit partially within the anchor housing, the bar tack clip comprising:

a cross beam, and at least one clip coupled to the cross beam and sized to mateably couple with the strap anchor; and a strap looped around the cross beam and coupled to itself with the bar tack.

9. The anchoring system of claim 8, wherein the at least one clip of the bar tack clip comprises two side clips.

10. The anchoring system of claim 8, wherein the at least one clip of the bar tack clip is disposed at an in-bound side of the bar tack clip, the in-bound side being perpendicular to sides of the bar tack clip.

11. The anchoring system of claim 8, wherein the strap is coupled to the bar tack clip without a pin.

12. The anchoring system of claim 8, wherein the at least one clip of the bar tack clip interlocks with the strap anchor to prevent the bar tack clip from being pulled out of, or away from, the strap anchor.

* * * * *